US005806346A

United States Patent [19]

Schlinger et al.

[11] Patent Number: 5,806,346

[45] Date of Patent: Sep. 15, 1998

[54] MAGNETIC PENDANT NECKLACE SET AND MANUFACTURE

[76] Inventors: Robin E. Schlinger, 123 Columbia St., Pasadena, Calif. 91105; Charlotte Widmer Varner, 2970 E. California Blvd., Pasadena, Calif. 91107-5347

[21] Appl. No.: 800,736

[22] Filed: Feb. 15, 1997

[51] Int. Cl.[6] ..... A44B 11/25; B21F 43/00

[52] U.S. Cl. ..... 63/40; 29/896.41; 29/896.42; 63/DIG. 9; 24/303

[58] Field of Search ..... 29/896.41, 896.42; 24/303; 63/29.2, DIG. 9, 40; 403/DIG. 1

[56] References Cited

U.S. PATENT DOCUMENTS

| | | | |
|---|---|---|---|
| 2,615,227 | 10/1952 | Hornik | 63/900 |
| 2,637,887 | 5/1953 | Goodman et al. | 24/303 |
| 2,659,169 | 11/1953 | Brennan | 63/29.2 |
| 3,263,444 | 8/1966 | DiCroce | 63/29.2 |
| 3,509,734 | 5/1970 | Lederer | 63/29.2 |
| 4,231,137 | 11/1980 | Fujimoto | 24/201 B |
| 4,265,098 | 5/1981 | Wayne | 63/2 |
| 4,270,366 | 6/1981 | Green | 63/40 |
| 4,901,405 | 2/1990 | Grover | 24/303 |
| 4,912,944 | 4/1990 | Crosley | 63/29.2 |
| 5,008,984 | 4/1991 | Levy | 24/303 |
| 5,031,420 | 7/1991 | Song | 63/21 |
| 5,050,276 | 9/1991 | Pemberton | 24/303 |
| 5,099,659 | 3/1992 | Carranza | 63/2 |
| 5,197,168 | 3/1993 | Levy | 24/303 |
| 5,245,844 | 9/1993 | Panzer | 63/2 |
| 5,323,516 | 6/1994 | Hartmann | 24/303 |
| 5,392,497 | 2/1995 | Defner | 24/303 |
| 5,432,986 | 7/1995 | Sexton | 24/303 |
| 5,572,887 | 11/1996 | Geswelli | 63/3 |

FOREIGN PATENT DOCUMENTS

| | | | |
|---|---|---|---|
| 656059 | 1/1963 | Canada | 63/29.2 |
| 1537955 | 8/1968 | France | 63/29.2 |
| 914208 | 12/1962 | United Kingdom | 24/303 |

*Primary Examiner*—P. W. Echols

[57] ABSTRACT

A method of inexpensively making a magnetic pendant necklace set relies upon affixing opposite-polarity magnets of at least 27 megagauss oersteds in pole strength to each of two, substantially-flat ornamental settings with protruding rings to which the opposite ends of any type of necklace can be attached. The ornamental settings function (1) as a pendant clasp when joined together by their magnet centers and also (2) as a secure mount for the easy attachment of magnet-studded, pendant ornaments.

8 Claims, 1 Drawing Sheet

MAGNETIC PENDANT NECKLACE SET AND MANUFACTURE

BACKGROUND—FIELD OF THE INVENTION

This invention relates to jewelry, particularly to a method of making a magnetic pendant necklace set that utilizes the high strength of sintered neodymium-iron-boron magnets for pendant ornament and necklace clasp attachment.

BACKGROUND—DESCRIPTION OF PRIOR ART

Pendant connectors, pin to pendant converters, and magnetic necklace clasps are known in the prior art. Most of the magnetic necklace clasp prior art specifies the use of one or more magnets that remain magnetized in the face of stray magnetic fields, mechanical shock, and elevated temperatures. These magnets are known as permanent magnets. There are three types of permanent magnets currently in use; alnicos, hard ferrites, and rare-earth magnets. The two types of commercially available, rare-earth magnets, neodymium-iron-boron (Nd-Fe-B) and samarium cobalt (SmCo), are much stronger permanent magnets than alnicos or hard ferrites (refrigerator magnets). A hard ferrite magnet would have to be ten times the size of either of these rare-earth magnets to achieve the same holding strength.

A permanent magnet's holding strength derives from the magnet's atomic structure and from the magnet's method of manufacture. A samarium cobalt magnet holds its standard property in higher maximum temperatures than a neodymium-iron-boron magnet, but the neodymium magnet achieves a higher maximum energy product as measured in megagauss-oersteds. Samarium cobalt is more brittle than neodymium-iron-boron and it also is more expensive, largely because samarium is the least abundant of the light rare-earth elements and the bulk of the world's supply is mined in only one country. Sintered neodymium-iron-boron magnets processed by a melting method are about three times stronger than bonded neodymium-iron-boron magnets processed by a gluing method. Because holding strength, cost, and stability are the most relevant factors to magnets used in jewelry production, sintered neodymium-iron-boron magnets are the best magnets to use in manufacturing a convertible magnetic pendant clasp necklace. These magnets are the subject of U.S. Pat. Nos. 4,770,723, 1988 Sep. 13, and 4,792,368, 1988 Dec. 20, to Sagawa et al. In the words of a recent electrical patent that touted the virtues of these magnets, "the use of relatively strong magnetic materials permits less magnetic material to be used to achieve the same magnetic strength than if weaker magnetic material were used." See U.S. Pat. No. 5,561,486 to San Gregory, 1996 Oct. 1.

A necklace clasp constructed simply of thin, inset, sintered neodymium-iron-boron magnets with a thickness pole orientation can be very small and still hold together very tightly. Such a clasp does not require either a mechanical safety closure or a mechanical release device. Simply sliding the two parts of the clasp in opposite directions disconnects it. This method of disconnection also makes the clasp safer to use on more expensive necklaces that a wearer would prefer to have break away rather than apart when grabbed by a small child or caught accidentally on a protrusion.

The prior art magnetic necklace clasps are expensive to fabricate, largely because they contain integrated mechanical safety closures, interfitting pieces, release devices, and locks. These same features make these prior art clasps more difficult to operate than a clasp constructed simply of inset sintered neodymium-iron-boron magnets. Since children and persons with limited hand dexterity like to wear necklaces, a simple-to-operate necklace clasp becomes an important part of pendant necklace manufacture. When the clasp's functioning involves even mechanical manipulation as simple as rotating the clasp's two parts in opposite directions, fastening and unfastening becomes difficult for these persons.

Another limitation of known magnetic necklace clasps is their inability to serve as a mount for pendant ornamentation. A magnetic clasp must have a flat center if it is to serve as such a mount. If the clasp has a center that is cylindrical, cubed, or polygonal in cross section, or if the center is uneven in any way due to the presence of integrated latches or release devices, pendant ornaments will tilt or fall off when bumped.

Currently, one must purchase a separate jewelry finding to create a pendant necklace set. These findings are known in the trade as necklace enhancers. Pendant-connector enhancers such as the devices specified in U.S. Pat. No. 4,265,098 to Wayne, 1981 May 5, and U.S. Pat. No. 5,031,420 to Song, 1991 Jul. 16, rely on hinged construction. Unlike permanent magnetism, a mechanical hinge is prone to failure with repeated use. In addition:

- pin to pendant converter enhancers, such as that specified in U.S. Pat. No. 5,245,844 to Panzer, 1993 Sep. 21, work only with chain necklaces, not with beaded ones;
- pin to pendant converters and pendant connectors are difficult to operate because they require fine hand manipulations; and
- a pendant connector with an attached pendant or a pin converter with an attached pin can easily slide off a thin necklace.

Another drawback to using pendant connectors and pin converters to create pendant necklaces is that these devices do not solve the problem of the sliding necklace clasp. Any necklace clasp tends to slide with its associated necklace from the back of a wearer's neck to the front unless the necklace's pendant is much heavier than its clasp. For aesthetic reasons, necklace wearers try to avoid sliding clasps. This problem is eliminated when the clasp serves both as a necklace pendant and as a mount for removable and interchangeable pendant ornaments.

OBJECTS AND ADVANTAGES

Accordingly, several objects and advantages of the present invention are:

(1) to provide a method for making a pendant necklace that all persons can fasten and disconnect easily;

(2) to provide a method for making a pendant necklace that holds securely but that unfastens when pulled before the necklace is damaged or injury results;

(3) to provide a method for making an aesthetically-pleasing pendant necklace that uses three magnets to provide secure attachment between the necklace's pendant clasp and a removable and interchangeable pendant ornament; and (4) to provide a method of making a magnetic pendant necklace set that is inexpensive.

Further objects and advantages are to provide a method of making a pendant necklace set that works with different types of necklaces that solves the problem of the sliding necklace clasp. Still further objects and advantages will become apparent from a consideration of the ensuing description.

DRAWING FIGURES

FIGS. 1*a* and 1*b* show opposite-polarity, disk magnets affixed to the substantially-flat centers of two ornamental settings.

Figures 7A, 7B:
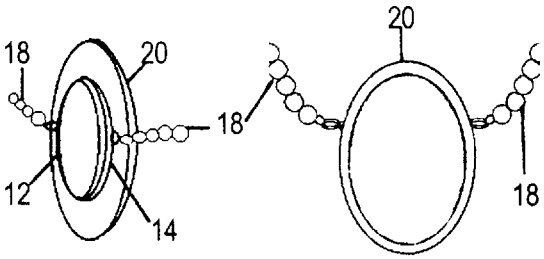

FIGS. 7*a* and 7*b* show the back view and the front view, respectively, of a magnet-studded pendant ornament attached to the pendant clasp of a necklace made in accordance with the method of this invention.

Figure 8:
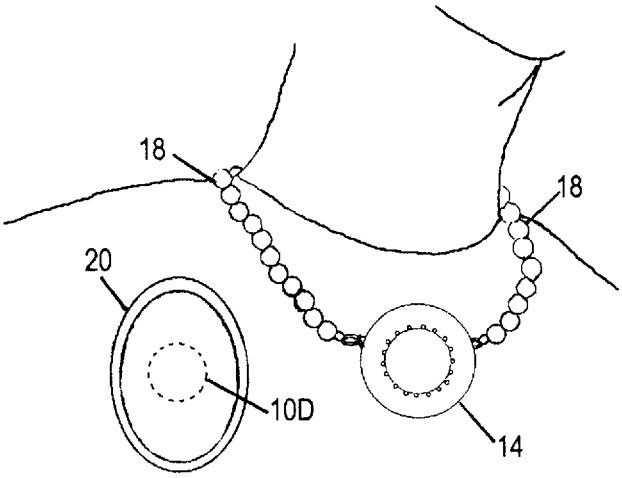

FIG. 8 shows a magnetic pendant necklace set that includes a fourth magnet so that a wearer can wear the pendant necklace and the removable pendant ornament independently.

REFERENCE NUMERALS IN DRAWINGS

10 magnet
12 first ornamental setting of clasp
14 second ornamental setting of clasp
16 glue
18 necklace
20 pendant ornament

DETAILED DESCRIPTION

Figures 1A, 1B:
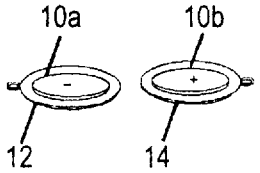
Figure 5:
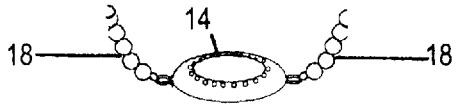
FIG. 5 shows the pendant clasp of a necklace made in accordance with the method of this invention.
Figure 2:
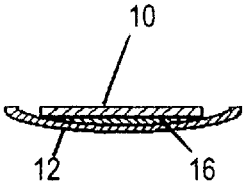
FIG. 2 is a cross section of FIG. 1*a* showing how a magnet is affixed with glue to an ornamental setting.
Figure 6:
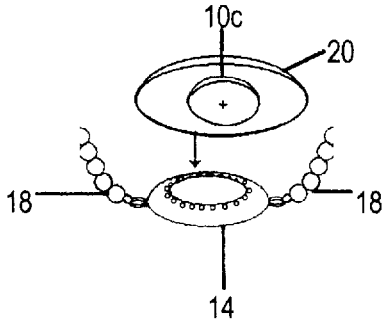
FIG. 6 shows a magnet-studded pendant ornament being attached by magnetic attraction to the pendant clasp of a necklace made in accordance with the method of this invention.
Figure 3:
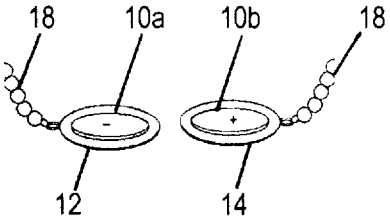
FIG. 3 shows a necklace attached to the magnet-studded, ornamental settings shown in FIGS. 1*a* and 1*b*.
Figure 4:
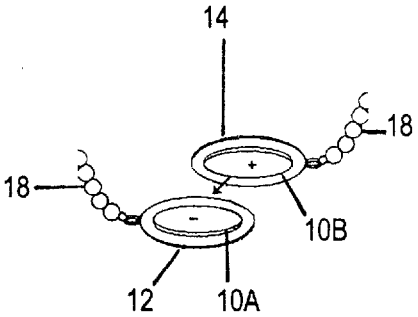
FIG. 4 shows the use of magnetic attraction for connection of a necklace's ornamental pendant clasp.

The objects set forth above are accomplished by:

(1) affixing a plated, sintered neodymium-iron-boron magnet with a thickness pole orientation and with a pole strength of at least 27 megagauss oresteds 10*a* to a substantially-flat, ornamental setting 12 using a styrene-based, self-leveling adhesive 16 (FIG. 1*a*);

(2) affixing an opposite-polarity, plated, sintered neodymium-iron-boron magnet with a thickness pole orientation and with a pole strength of at least 27 megagauss oresteds 10*b* to another substantially-flat, ornamental setting 14 using a styrene-based, self-leveling adhesive 16 (FIG. 1*b*);

(3) attaching one end of a necklace 18 to each magnet-studded ornamental setting (FIG. 3);

(4) bringing the two ornamental settings with their associated necklace ends into close proximity and allowing attractive magnetic force to attach the settings together, thereby forming a pendant clasp for the necklace (FIGS. 4 and 5);

(5) affixing a plated sintered neodymium-iron-boron magnet with a thickness pole orientation and with a pole strength of at least 27 megagauss oresteds to the back side of a removable and interchangeable pendant ornament 20 using a styrene-based, self-leveling adhesive 16 (FIG. 6); and (6) allowing attractive magnetic force to attach the pendant ornament 20 to the necklace (FIGS. 7 and 7*a*) or, by use of a fourth magnet 10*d*, to fabric (FIG. 8).

For aesthetic reasons, the sintered neodymium-iron-boron magnets should not exceed 1.52 mm in thickness.

SUMMARY, RAMIFICATIONS, AND SCOPE

The method of this invention can be used to create a simple-to-fasten pendant necklace that quickly and securely accepts an ornament that also will attach non-invasively to a backing magnet through fabric. The alternative ornamentation will jump onto the magnetic pendant mount the same way it jumps non-invasively to a backing magnet through fabric when used as a brooch. With this method, securing the necklace clasp and attaching a pendant ornament becomes easier for everyone, including children and persons with limited hand dexterity. The method has additional advantages in that:

it is inexpensive because separate necklace clasp and necklace pendant connection findings are not required, it prevents the aesthetic disadvantage of a sliding necklace clasp, and it provides the possibility of using any type of pendant ornament as long as the ornament can support a magnet similar in size to the necklace clasp magnets.

Products made according to the method of the invention described above also fall within the scope of the invention. The foregoing has been a description of the preferred embodiment of the method of the invention. Furthermore, the foregoing description sets forth the best mode of practicing the invention contemplated by the inventors as of the date of execution of the specification. In particular, it is believed that other adhesives will be found to be adequate to the job of affixing the magnets. A different rare-earth compound with greater magnetic strength and equal or lesser cost may prove to be a better magnet for jewelry production than sintered neodymium-iron-boron. The disclosures regarding the styrene-based, self-leveling adhesive and the neodymium-iron-boron magnet compound are made in compliance with the best mode requirement of the patent law and are not intended to be limiting of the scope of the present invention. In addition, there are various possibilities with regard to the shape, strength, and surface coating of the magnets used in the disclosed method of making a magnetic pendant necklace set. For instance, sintered neodymium-iron-boron magnets are regularly manufactured in circular, cylindrical, square, and rectangular shapes with orientation through the thickness and a magnetic force ranging from 27 to 45 megagauss oersteds.

The magnets can be manufactured in thicknesses as small as 0.762 millimeters. With tumbling before plating, common or precious metal magnet plating is possible and indeed advisable to prevent corrosion and improve aesthetic appearance. Substantially-flat, ornamental metal stampings are commercially available in numerous styles and shapes, many with one or more protruding rings to which necklaces of any type can be attached either before or after the pendant clasp magnets are affixed to their settings.

Thus, the scope of this invention should be determined by the appended claims and their legal equivalents."

We claim as our invention:

1. A method of manufacturing a magnetic pendant necklace set comprising the steps of:

(a) attaching one end of a necklace to a substantially-flat ornamental setting containing a magnet with a pole strength of at least 27 megagauss oersteds;

(b) attaching the other side of the necklace to a second substantially-flat ornamental setting containing an opposite-polarity magnet with a pole strength of at least 27 megagauss oersteds;

(c) securing the necklace clasp by attaching the two ornamental settings to one another using the attractive magnetic force between the opposite-polarity magnets in said settings in order to form a necklace with a clasp that also serves as (i) a mount for removable and interchangeable ornaments and (ii) a necklace pendant; and (d) affixing a third magnet with a pole strength of at least 27 megagauss oersteds to an ornament that attaches by attractive magnetic force to the necklace's clasp.

2. The method of claim 1 wherein the necklace clasp magnets are glued onto ornamental settings of metal stampings or castings with one or more protruding rings.

3. The method of claim 1 wherein the necklace clasp and removable pendant ornament magnets are glued onto ornamental settings of metal stampings or castings.

4. The method of claim 1 wherein the magnets are sintered neodymium-iron-boron magnets.

5. The method of claim 1 wherein the necklace clasp magnets are 1.52 mm or less in thickness.

6. The method of claim 1 wherein a fourth magnet having a pole strength of at least 27 megagauss oersteds is provided with the set so that said ornament can be secured to fabric if a wearer wants to wear the pendant necklace and ornament independently but at the same time.

7. A product made in accordance with the method of claim 1.

8. A product made in accordance with the method of claim 7.

* * * * *

UNITED STATES PATENT AND TRADEMARK OFFICE

CERTIFICATE OF CORRECTION

PATENT NO. : 5,806,346

DATED : Sept. 15, 1998

INVENTOR(S) : Robin E. Schlinger, et al

It is certified that error appears in the above-identified patent and that said Letters Patent is hereby corrected as shown below:

Column 6, Line 9, change "7" to "6"

Signed and Sealed this

Twentieth Day of April, 1999

*Attest:*

Q. TODD DICKINSON

*Attesting Officer*

*Acting Commissioner of Patents and Trademarks*